US005460557A

United States Patent [19]

Arnold

[11] Patent Number: 5,460,557

[45] Date of Patent: Oct. 24, 1995

[54] SWIM FIN

[76] Inventor: Felix Arnold, Langenthalerstr. 37, 69239 Neckarsteinach-Grein, Germany

[21] Appl. No.: 199,192

[22] PCT Filed: Aug. 29, 1991

[86] PCT No.: PCT/DE91/00683

§ 371 Date: Apr. 26, 1994

§ 102(e) Date: Apr. 26, 1994

[87] PCT Pub. No.: WO93/04740

PCT Pub. Date: Mar. 18, 1993

[51] Int. Cl.[6] ..... A63B 31/11

[52] U.S. Cl. ..... 441/64

[58] Field of Search ..... 441/60, 61, 64

[56] References Cited

U.S. PATENT DOCUMENTS

| | | | |
|---|---|---|---|
| 3,239,857 | 3/1966 | Gwynne | 441/64 X |
| 3,665,535 | 5/1972 | Picken | 441/64 |

FOREIGN PATENT DOCUMENTS

| | | | |
|---|---|---|---|
| 1373065 | 8/1964 | France | 441/64 |
| 2493157 | 5/1982 | France | 441/64 |
| 3438808 | 4/1986 | Germany . | |
| 0676938 | 11/1964 | Italy | 441/64 |

*Primary Examiner*—Sherman Basinger

*Attorney, Agent, or Firm*—Edwin E. Greigg; Ronald E. Greigg

[57] ABSTRACT

A swim fin (1) for divers or swimmers, having a freely leading profile (7) as the fin blade, which always has a positive angle of attack on both the upwardly (II) and the downwardly (I) oriented stroke of the fin with respect to the oncoming flow direction of the water, which is a product of the forward motion and the stroke of the fin, wherein to increase the propulsive action with simultaneously great freedom of motion of the diver or swimmer, the profile (7) is disposed downstream, in the swimming direction, of the foot (11) of the diver or swimmer and is always located in the undertow of the foot of the swimmer, whether the stroke of the fin is oriented upward (II) or downward (I).

17 Claims, 3 Drawing Sheets

SWIM FIN

The invention is based on a swim fin for divers or swimmers, as defined hereinafter. Swim fins of this kind are intended to increase the forward speed of a diver or swimmer in that as a result of the up-and-down motion of the swim fin in the water, buoyancy acting on the fin is produced, whose component in the forward motion direction exerts forward thrust upon the diver or swimmer.

SUMMARY AND OBJECTS OF THE INVENTION

In contrast to conventional swim fins, which are embodied in the shape of the tail fin of a fish, generic swim fins have a freely leading profile as a fin blade that on both the upwardly and the downwardly oriented stroke of the fin is kept at a positive angle of attack with respect to the oncoming flow direction of the water, which is a product of the forward motion and the stroke of the fin. Similarly to what happens with an airplane wing, this oncoming flow to the profile at a positive attack angle produces a circulation around the profile, which is superimposed on the water flowing toward it. This builds up a pressure system that causes overpressure on one side of the profile, and negative pressure on the other.

By varying the attack angle, depending on the direction of the stroke of the fin, it is attained that the buoyancy always has a component in the forward motion direction, which acts as a forward thrust upon the swimmer or diver. With such swim fins, a much higher forward motion speed is achieved than with conventional swim fins lacking a freely leading profile.

It is known for a swim fin of this generic type to be embodied like the tail fin of a dolphin (Published German Patent Application DE-OS 34 38 808). Such swim fins have the form of an airfoil of great length, and each fin of a pair of fins is provided with an airfoil that points laterally outward from the leg of the swimmer or diver.

Because of this unilateral disposition of the airfoil on the swim fin, the result when the fin strokes through the water is a torsional effect on the leg of the diver or swimmer. Hence such swim fins are either embodied as a monofin, with two receptacles for both feet of the diver or swimmer and two airfoils each pointing outward, or else a second airfoil of slight length must be produced on the side opposite the airfoil of great length, i.e., between the legs or feet of the diver or swimmer, in order to compensate for the torsional effect. Both versions have the disadvantage of drastically impeding the freedom of motion of the diver or swimmer both on land and in the water.

The object of the invention is therefore to create a swim fin that on the one hand enables high forward motion speeds and on the other limits the freedom of motion of the diver or swimmer only a little or not at all.

This object is attained by the swim fin of the invention, having the characteristics set forth hereinafter.

Because the profile is disposed downstream, in the swimming direction, of the foot of the diver or swimmer and is always located in the undertow of the foot of the swimmer, whether the stroke of the fin is oriented upward or downward, optimal flow conditions are attained, which among other consequences lead to a later separation of the eddy arising at the top of the flow over the profile, and hence to less flow resistance. In other words, this maintains a laminar flow on the negative-pressure side of the profile for a longer time. As a result of these provisions, on the one hand, the buoyancy of the swim fin is increased, and on the other, its flow resistance is reduced.

In an advantageous feature of the invention, the profile has a slight length and in outline is embodied symmetrically with respect to the longitudinal axis of the leg, extending through the knee of the swimmer or diver. This averts a torsional affect on the swimmer's or diver's leg. The resultant reduced width of the profile is compensated for by the optimal streamlining.

In an advantageous feature of the invention, lateral struts are disposed on both longitudinal sides of the profile, which on the other side are joined to a cuff that can be pulled on over the lower leg of the swimmer. This feature has the advantage that the swim fin can be connected to the leg of the diver or swimmer without affecting the mobility of his foot. The swimmer's foot may be either bare or covered with a swimming shoe, and can remain unimpeded both when stroking up and down in the water and when walking on land. By the establishment of a fixed angle between the struts and the longitudinal axis of the lower leg, which angle is between the maximum and minimum angle that can be enclosed by the instep and the shin, it is assured that when the fin is stroking, the profile will always be located in the undertow of the swimmer's foot. An undertow of the swimmer's foot is such that during movement of the swimmers legs the water streams along the instep of the foot and through a gap between the foot and the fin-profile and towards the fin-profile. This water stream is therefore considered the undertow of the foot and is directed from the foot toward the fin-profile. Therefore, the fin-profile always remains in the undertow.

In another advantageous feature of the invention, the struts disposed laterally on the profile are enlarged, in the region of the profile, into a face that is perpendicular to the face of the profile. This feature has the advantage of reducing the development of eddies at the lateral ends of the profile. Such a feature has the effect of increasing the span width of the profile.

In another advantageous feature of the invention, the profile has a rigid symmetrical form. A symmetrical profile form has the same flow behavior in both stroking directions of the fin. The rigid profile form can be optimized in terms of buoyancy and flow resistance, but a compromise between buoyancy and flow resistance must be found.

In an advantageous feature of the invention, the lateral struts are rotationally elastically joined to the profile, the axis of rotation being located upstream of the center of lift. Because of this feature, when the fin strokes the water, a positive angle of attack of the profile with respect to the resultant flow is always achieved. Because the center of lift is located downstream of the axis of rotation, the profile inclines downward with its front edge on the downstroke, while it inclines upward on the upstroke. The size of the thus-established angle of attack is the product of the spring constants of the rotationally elastic connection.

In another advantageous feature of the invention, the profile is embodied by a membrane that can be flipped over between two extreme positions in which it assumes a predetermined and in particular asymmetrical form. In contrast to the rigid profile, the membrane profile can change its form, so that it is possible to establish the buoyant side of the profile on one side or the other depending on the direction of the stroke. In this feature, it is possible to use an asymmetrical profile form, which has greater buoyancy, instead of the symmetrical profile.

In an advantageous feature of the invention, the profile membrane is disposed in a frame that is supported rotatably between the two lateral struts. This feature has the advantage that the profile can be optimized in terms of buoyancy and flow resistance, and the profile can be embodied as self-adjusting and self-stabilizing with respect to the angle of attack.

In another advantageous feature of the invention, the swim fin is provided with a shoe for the swimmer's foot. This feature is advantageously further developed by providing that approximately at the level of the ankle bone, the shoe has a swivel connection with the lateral struts. As a result, the shoe and the cuff form a cohesive element with the blade of the fin.

In another advantageous feature of the invention, the shoe has a form with low flow resistance. This feature has the advantage that the flow conditions around the swimmer's or diver's foot are improved. This is especially important because the profile of the swim fin is located in the undertow of the foot. The less turbulent this flow is, the longer can eddying of the flow at the profile be kept low.

In another advantageous feature of the invention, downstream of the profile in the swimming direction is a further profile, which has a form with low flow resistance. As a result of this feature, the eddying downstream of the first profile is advantageously reduced, which improves the energy balance of the overall system.

In an advantageous feature of the invention, the further profile downstream of the first profile is rotationally elastically joined to the first profile via two lateral struts. This feature assures that the further profile will always be located in the flow over the top of the first profile, in both fin stroke directions. The orientation of this further profile with respect to the first profile or to the flow can be determined in turn by a rotationally elastic connection between the struts and the further profile, in combination with a suitable disposition of the axis of rotation.

In another advantageous feature of the invention, the swim fin is embodied as a monofin. This feature has the advantage, in addition to the broader utility of the swim fin of the invention, that the span width of the profile can be increased. To avoid torsion, the profile of the monofin must be embodied symmetrically to the longitudinal axis through the center of the body of the diver or swimmer. Nor need a shoe be provided for both feet, and so normal walking on land is possibly simply by disconnecting the struts from the cuffs.

Further advantages and advantageous features of the invention may be learned from the ensuing description, the drawing, and the claims.

BRIEF DESCRIPTION OF THE DRAWINGS

One exemplary embodiment of the subject of the invention is shown in the drawing and described in detail below. Shown are.

DETAILED DESCRIPTION OF THE DRAWINGS

Figure 1:
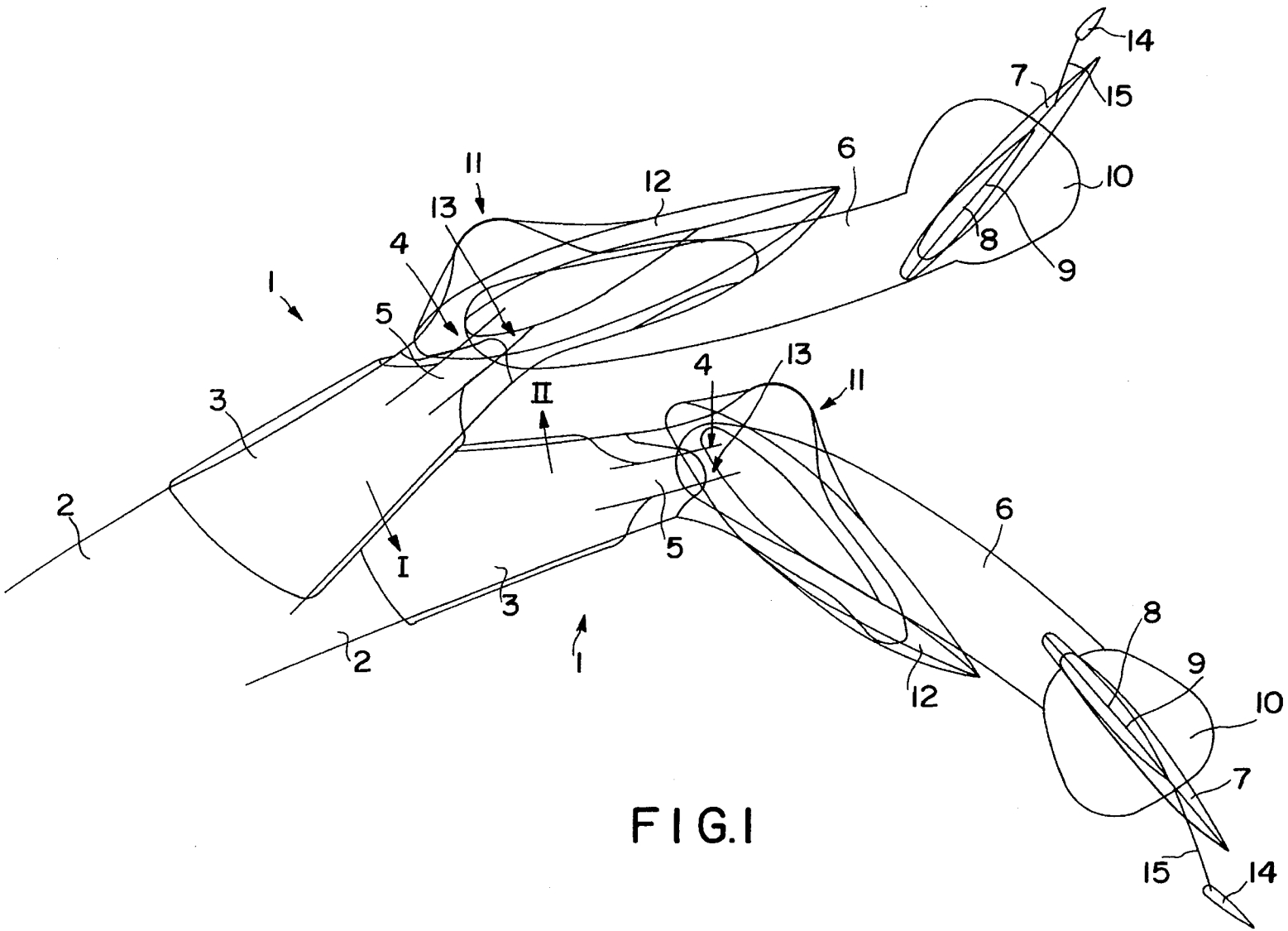
FIG. 1, a side view of a swim fin according to the invention, on both the upstroke and the downstroke.

The swim fin 1 shown at the top in FIG. 1 is on the downstroke (arrow I), while the same swim fin 1 is shown at the bottom of FIG. 1 on the upstroke (arrow II). The swim fin 1 has a cuff 3 which is an upper portion of a foot covering means 12, which is wrapped around the lower leg portion 2 of a swimmer and ends above the ankle bone 4 of the ankle joint.

The cuff 3 is fixedly joined angularly, via a pair of oppositely disposed straps 5 extending over the ankle bone 4, to one end of a pair of oppositely disposed angularly related struts 6, which on their other end have a rotationally elastic connection with a profile 7 which is limited in its angular rotation relative to the ends of the struts 6. The axis of rotation 8 of this rotationally elastic connection is located upstream, in the forward motion direction, of the axis 9 through the center of lift.

Figure 3:
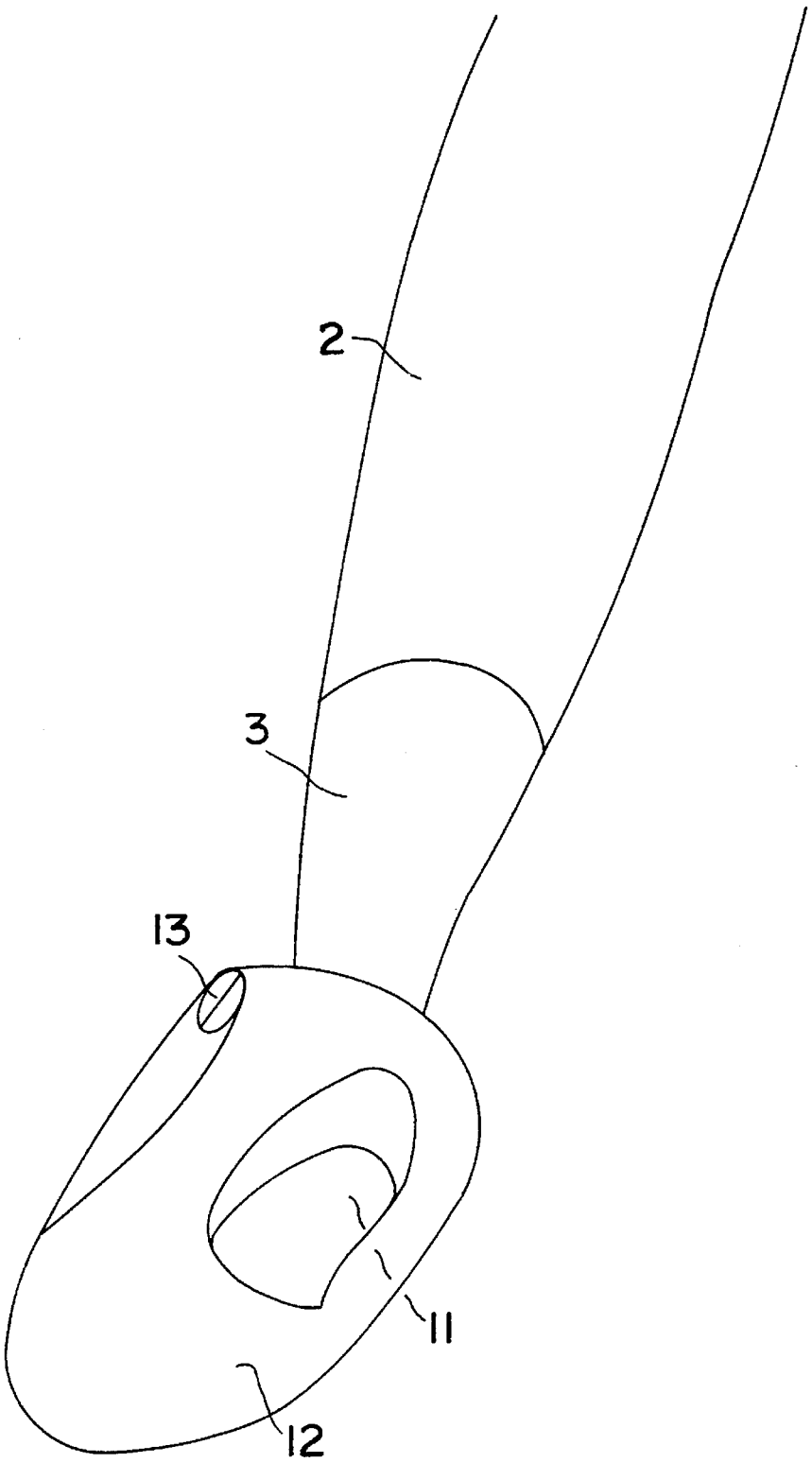
FIG. 3, a perspective view from behind of part of a swim fin according to the invention.

In the region of the profile 7, each of the struts 6 is widened along their length into a face 10, disposed perpendicular to the axis 9 of the profile face, that reduces eddying at the lateral ends of the profile. The profile 7 is positioned between the widened faces and limited in its rotation by the elastic connection. The foot 11 of the swimmer or diver is located in a shoe 12, which likewise has a form with low flow resistance. One possible embodiment of the shoe 12 can be learned from FIG. 3.

At the level of the ankle bone 4, the shoe 12 has a swivel connection 13 with the struts 6. As a result, on the one hand the shoe 12 is joined to the swim fin 1, and on the other it is rotatable relative to the struts 6, so that the foot and the shoe are swivelable in between the struts between the position shown in the upper half of FIG. 1 and the position shown in the lower half of FIG. 1.

Figure 2:
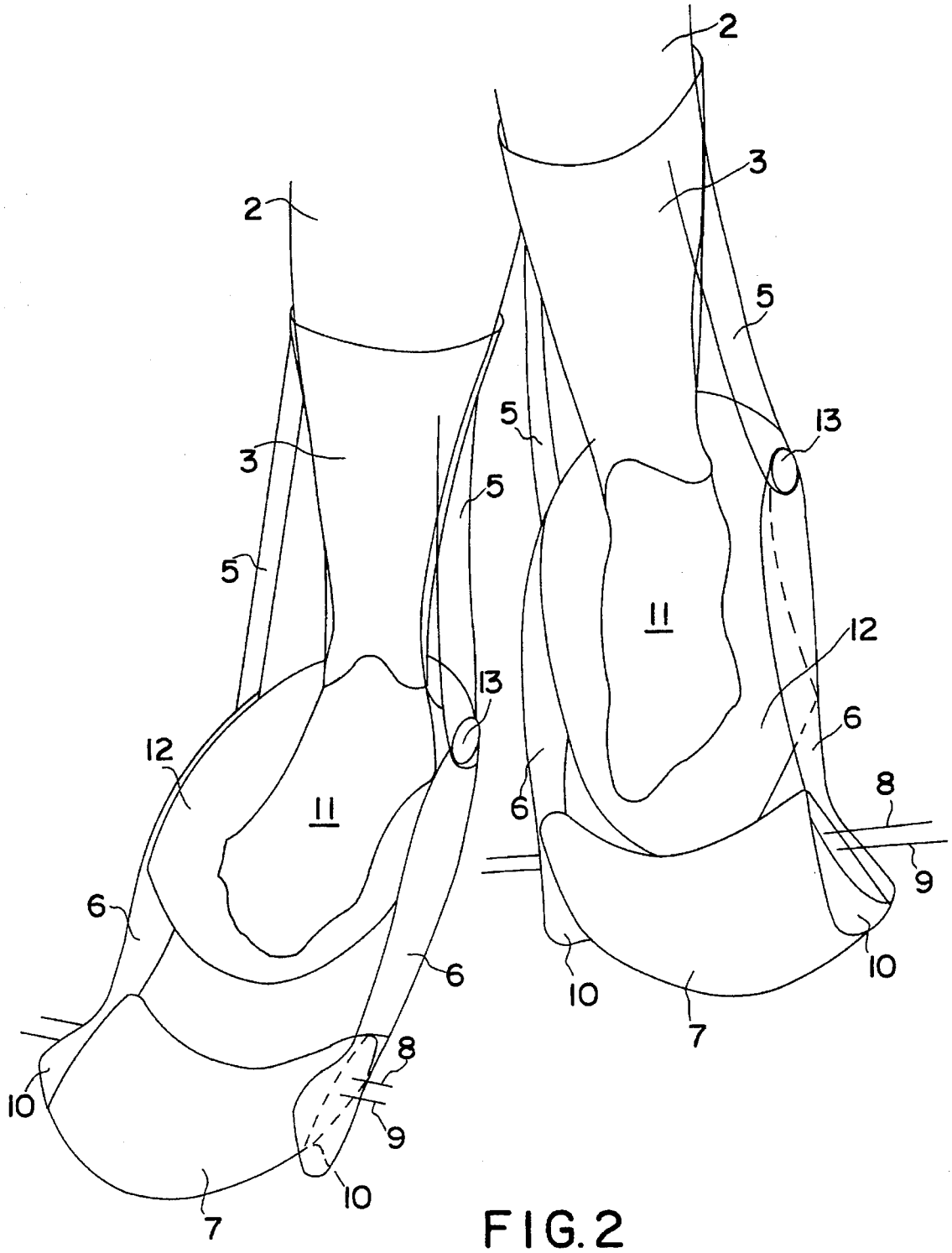
FIG. 2, a perspective view of a swim fin according to the invention, showing it on both the upstroke and the downstroke.

FIG. 2 shows the swim fin on the downstroke (arrow I) on the right and on the upstroke (arrow II) on the left.

In order to move himself forward, the swimmer or diver, similarly to what he does with conventional swim fins, executes a contrary upward and downward motion with his two legs; at each turning point, his foot 11 with the shoe 12 is moving between the two lateral struts 6, so that in either stroke direction, the profile 7 is located in the undertow of the shoe 12, that is, the water streams between the profile of the foot or foot covering and the freely leading profile. The oncoming flow to the profile 7 engendered by the stroking motion leads to a flipping over of the profile 7, disposed rotationally elastically between the two lateral struts 6, counter to the elastic spring force at the turning point, in such a way that the profile 7 always has a positive angle of attack relative to the oncoming flow that results from the forward motion of the swimmer or diver and from the stroking motion. One end of the struts is fixed to the cuff and on their other end they are disposed on the profile. The material of the struts is rather rigid, especially at the end that is fixed to the cuff. That is why the angle between the leg of the swimmer and struts is kept fixed while the foot can move, so that the angle between the foot and leg changes. The fixed angle has to be an angle between the maximum and the minimum angle that can be enclosed between the instep and the shin of the swimmer. Due to the short length of the profile and its symmetry a torque that acts on the leg can be avoided, especially on the knee and the ankle of the swimmer when the leg is moved up and down.

As a result of this oncoming flow to the profile 7, the profile is lent buoyancy approximately perpendicular to its face. This buoyancy always has a component in the direction of forward motion of the diver or swimmer, which acts on him in the form of a forward thrust. Because the profile 7 is located in the undertow of the shoe 12, the flow persists longer on the buoyancy side of the profile 7, resulting in less flow resistance of the swim fin 1. The flow around the profile 7 can be still further improved by providing that the profile 7 is followed downstream by a further profile 14, which is rotationally elastically joined to the profile 7 via a strut 15. This further profile 14 is located preferentially in the flow over the top of the profile 7. This is assured by the rotationally elastic connection with the profile 7. The angle of attack of the profile 14 relative to the flow over the top of the profile 7 is determined in turn by a suitable disposition of the axis of rotation and the axis through the center of lift at the profile 14 (FIG. 1).

The connection of the struts 6 to the shoe 12 via the swivel connection 13 may advantageously be made disconnectable, so that the profile 7 with the two struts 6 can easily be removed from the swim fin. This enables one to walk unhindered on land with the swim fin according to the invention.

All the characteristics represented in the description, the ensuing claims and the drawing may be essential to the invention either individually or in any arbitrary combination with one another.

I claim:

1. A swim fin for swimmers and divers in water which comprises a foot covering means (12) in which a foot of a swimmer can be inserted, said foot covering means including a cuff (3) which fits over a lower leg portion of said swimmer including an ankle, oppositely disposed strap means (5), one end of each of said oppositely disposed strap means being connected to said cuff, another end of each of said oppositely disposed strap means being angularly connected to one end of oppositely disposed lateral struts (6) on opposite sides of said foot covering means at an angle relative to said strap means, a profile (7) rotationally secured between another end of each of said struts whereby said profile (7) is disposed dove,stream, in a swimming direction of said foot covering means which on both an upwardly and a downwardly oriented stroke of the fin always has a positive angle of attack with respect to an oncoming flow direction of the water, which is a product of a forward motion and a stroke of the fin, the profile is always located in an undertow of the foot (11) of the swimmer.

2. The swim fin as defined by claim 1, in which the struts (6) are disposed laterally on the profile (7) and are enlarged, in a region of the profile (7), into a face (10) that is perpendicular to an axis of rotation (8) of the profile.

3. The swim fin as defined by claim 2, in which the profile in outline is embodied symmetrically with respect to a longitudinal axis of the swimmer's leg, extending through a knee of the swimmer.

4. The swim fin as defined by claim 3, in which the profile (7) is rotationally elastically joined to the lateral struts (6), said profile (7) being located upstream of the axis (9) through a center of lift.

5. The swim fin as defined by claim 2, in which the profile (7) is rotationally elastically joined to the lateral struts (6), said profile (7) being located upstream of the axis (9) through a center of lift.

6. The swim fin as defined by claim 2, in which the swim fin (1) is provided with a shoe (12) for the foot (11) of the swimmer.

7. The swim fin as defined by claim 1, in which the profile in outline is embodied symmetrically with respect to a longitudinal axis of the swimmer's leg, extending through a knee of the swimmer.

8. The swim fin as defined by claim 7, in which the profile (7) is rotationally elastically joined to the lateral struts (6), said profile (7) having an axis of rotation (8) being located upstream of the axis (9) through a center of lift.

9. The swim fin as defined by claim 7, in which the swim fin (1) is provided with a shoe (12) for the foot (11) of the swimmer.

10. The swim fin as defined by claim 1, in which the profile (7) is rotationally elastically joined to the lateral struts (6), said profile (7) having an axis of rotation (8) being located upstream of the axis (9) through a center of lift.

11. The swim fin as defined by claim 1, in which the swim fin (1) is provided with a shoe (12) for the foot (11) of the swimmer.

12. The swim fin as defined by claim 11, in which approximately at a level of the ankle bone (4), the shoe (10) has a swivel connection (13) with the lateral struts (6).

13. The swim fin as defined by claim 12, in which the shoe (12) has a form with low flow resistance.

14. The swim fin as defined by claim 11, in which the shoe (12) has a form with low flow resistance.

15. The swim fin as defined by claim 1, in which downstream of the profile (7) in the swimming direction is a further profile (14), which has a form with a low flow resistance.

16. The swim fin as defined by claim 15, in which the further profile (14) is disposed in the flow over the top of the first profile (7).

17. The swim fin as defined by claim 16, in which the further profile (14) downstream of the first profile (7) is rotationally elastically joined to the first profile (7) via two lateral struts (15).

* * * * *